US010974856B2

(12) United States Patent
Prestine et al.

(10) Patent No.: US 10,974,856 B2
(45) Date of Patent: Apr. 13, 2021

(54) APPARATUS FOR FLUSHING PACKAGES WITH GAS

(71) Applicant: Campbell Wrapper Corporation, De Pere, WI (US)

(72) Inventors: Matthew B. Prestine, Green Bay, WI (US); Christopher J. Ricker, De Pere, WI (US); Brian L. Hopkinson, De Pere, WI (US)

(73) Assignee: Campbell Wrapper Corporation, De Pere, WI (US)

( * ) Notice: Subject to any disclaimer, the term of this patent is extended or adjusted under 35 U.S.C. 154(b) by 36 days.

(21) Appl. No.: 16/598,245

(22) Filed: Oct. 10, 2019

(65) Prior Publication Data

US 2020/0115079 A1 Apr. 16, 2020

Related U.S. Application Data

(60) Provisional application No. 62/744,905, filed on Oct. 12, 2018, provisional application No. 62/903,412, filed on Sep. 20, 2019.

(51) Int. Cl.
*B65B 31/04* (2006.01)

(52) U.S. Cl.
CPC ..... *B65B 31/042* (2013.01)

(58) Field of Classification Search
CPC ..... B65B 31/042; B65B 61/20; B65B 57/02; B65B 65/02; B65B 1/22; B65B 31/02; B65B 31/04
USPC ..... 141/11, 62, 63, 135, 136, 137, 140; 53/428, 432, 434, 510, 79, 403, 405, 408
See application file for complete search history.

(56) References Cited

U.S. PATENT DOCUMENTS

| | | | | | |
|---|---|---|---|---|---|
| 707,994 | A * | 8/1902 | Warren | B67C 3/18 | 141/136 |
| 2,517,616 | A * | 8/1950 | Weygant | B65B 1/24 | 141/80 |
| 2,581,795 | A * | 1/1952 | Howard | B65B 1/22 | 141/77 |
| 5,767,392 | A * | 6/1998 | Belcher | G01M 3/36 | 73/41 |
| 5,971,041 | A * | 10/1999 | Drewitz | B65B 39/14 | 141/135 |
| 6,321,813 | B1 * | 11/2001 | Miyajima | B29C 65/02 | 156/497 |
| 9,242,848 | B2 * | 1/2016 | Murray | B65B 31/044 | 141/54 |
| 9,802,507 | B2 * | 10/2017 | Clark | B65B 57/005 | |

(Continued)

*Primary Examiner* — Timothy L Maust
*Assistant Examiner* — James R Hakomaki
(74) *Attorney, Agent, or Firm* — Wood, Phillips, Katz, Clark & Mortimer

(57) ABSTRACT

An apparatus for flushing a plurality of randomly spaced packages with an inert gas includes a linear conveyor for conveying the packages, a linear servo motor, comprising a closed loop, positioned generally above the linear conveyor. The arrangement includes a plurality of gas-flushing nozzles which are mounted on the linear servo motor for movement in concert with the packages on the conveyor. Each nozzle can be selectively angularly positioned and articulated with respect to the linear servo motor to facilitate insertion into, and withdrawal from, each package to effect flushing of the contents of each package with an inert gas.

14 Claims, 6 Drawing Sheets

(56) References Cited

U.S. PATENT DOCUMENTS

| | | | | |
|---|---|---|---|---|
| 9,856,096 | B2 * | 1/2018 | Hanisch | B67C 3/18 141/136 |
| 10,239,418 | B2 * | 3/2019 | Cromheecke | B67C 7/0033 53/510 |
| 10,414,530 | B2 * | 9/2019 | Murray | F02K 9/82 60/200.1 |
| 10,608,518 | B2 * | 3/2020 | Brucker | G01D 5/2086 |
| 2003/0230941 | A1 * | 12/2003 | Jacobs | B29C 66/1122 310/12.19 |
| 2005/0108994 | A1 * | 5/2005 | Jacobs | B67C 7/0033 53/510 |
| 2007/0056261 | A1 * | 3/2007 | Lausten | F02K 9/82 60/200.1 |
| 2009/0223172 | A1 * | 9/2009 | Hirano | B65B 31/042 53/403 |
| 2010/0288394 | A1 * | 11/2010 | Larsen | B65B 31/042 141/10 |
| 2012/0210675 | A1 * | 8/2012 | Murray | B65B 31/042 53/403 |
| 2014/0331603 | A1 * | 11/2014 | Takahashi | B65B 31/06 53/408 |
| 2015/0203222 | A1 * | 7/2015 | Zonato | B65B 25/001 53/455 |
| 2015/0274342 | A1 * | 10/2015 | Zuccotti | B65B 7/28 53/67 |
| 2016/0096644 | A1 * | 4/2016 | Murray | B65B 31/044 141/54 |
| 2016/0185090 | A1 * | 6/2016 | Leonelli | B65B 51/306 156/583.5 |
| 2018/0072445 | A1 * | 3/2018 | Burkhard | B65B 59/003 |
| 2018/0072551 | A1 * | 3/2018 | Burkhard | B67C 3/225 |
| 2018/0216968 | A1 * | 8/2018 | Sun | G01D 5/2086 |
| 2019/0305662 | A1 * | 10/2019 | Fontanazzi | B65B 57/005 |

* cited by examiner

APPARATUS FOR FLUSHING PACKAGES WITH GAS

CROSS-REFERENCE TO RELATED APPLICATIONS

This application claims priority of Provisional Ser. No. 62/744,905, filed Oct. 12, 2018 and Provisional Ser. No. 62/903,412, filed Sep. 20, 2019, the disclosures of which are hereby incorporated by reference in their entireties.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates generally to a method of handling packages for maintaining the freshness of the contents of the packages, and more particularly to a method and apparatus for flushing the contents of packages with gas prior to sealing of the packages to maintain the freshness of the package contents.

BACKGROUND OF THE INVENTION

Many products which are generally granular or chunk-like in nature, such as pet food and the like, are packaged in bag-like flexible packaging for subsequent shipment, storage and consumption. The freshness of the package contents in maintained by sealing each package after filling, thereby limiting the egress of oxygen into the package, which can diminish freshness.

In order to further promote the freshness of the package contents, it can be advantageous to inject and flush the contents of each package with a relatively inert gas, such as nitrogen, argon, carbon dioxide, or the like, which acts to displace oxygen from the interior of each package to better maintain the freshness of the contents. As will be appreciated, however, effective flushing of each package with a suitable gas can be particularly problematic in a typical product-filling process, in which filled packages are typically presented for sealing on a linear conveyor, frequently in randomly spaced relationship to each other.

The present invention is directed to a method and apparatus by which filled packages which are linearly conveyed in randomly spaced relationship can be efficiently and consistently flushed with gas to maintain the freshness of the contents of each package.

SUMMARY OF THE INVENTION

The method and apparatus of the present invention are directed to injecting and flushing a plurality of linearly conveyed, randomly spaced packages with a relatively inert gas to promote and maintain the freshness of the contents of each package. Notably, this is achieved by the provision of a linear servo motor drive arrangement, having a plurality of selectively positionable gas nozzles, which can operate continuously, in conjunction with a linear package conveyor, to flush the interior of each package with gas attendant to sealing each package. The shelf life and quality of the contents of each package are desirably enhanced.

The present method of flushing packages with gas comprises the steps of linearly conveying a plurality of packages, each having an open mouth, including randomly spacing the packages from each other, as is typically performed in a packaging and sealing process.

The present method further includes providing a linear servo motor, having a plurality of independently positionable driven modules, positioned generally above the packages. The method further includes providing a plurality of gas nozzles each mounted on a respective one of the driven modules of the linear servo motor, and independently moving the gas nozzles on the linear servo motor. The linear servo motor comprises a closed loop positioned generally above the linearly conveyed packages, with each of the gas nozzles being independently movable about the closed loop.

In order to inject and flush each package with gas, the present method includes inserting each of the gas nozzles into a respective one of the packages through the open mouth thereof, while the gas nozzle is moved on the linear servo motor in concert with the respective package. Thus, the operation of the linear servo motor is coordinated with the linear conveyance of the packages to permit each gas nozzle to be positioned in a respective package as the packages are continuously linearly conveyed.

The present method includes flushing the interior of respective package with gas, and thereafter removing each the nozzle from the respective package. Closing of each package is effected during or just subsequent to removal of the gas nozzle from the package, with each package subsequently sealed.

Features of the present method promote continuous and efficient gas flushing of the packages. In the preferred practice, the present method includes selectively adjusting the relative angle of each of the gas nozzles with respect to the linear servo motor. In one illustrated embodiment, this is achieved by providing a pair of interconnected driven modules on the linear servo motor for moving each of the gas nozzles, and adjusting the relative spacing between the pair of driven modules for adjusting the relative angle of each gas nozzle with respect to the linear servo motor. In an alternative embodiment, a cam track arrangement is provided in operative association with the linear servo motor such that movement of each driven module relative to the cam track arrangement selectively adjusts the relative angle of each gas nozzle with respect to the linear servo motor Efficient operation is further promoted by vibrating each of the packages during insertion of each gas nozzle to facilitate insertion of each gas nozzle into contents of each package. For contents which are granular or chunk-like in nature, vibrating each package tends to "fluidize" the contents, facilitating insertion of the gas nozzle into the contents for efficient injection and flushing with gas.

An important aspect of the present invention includes sensing and detecting the position of each of packages as it is linearly conveyed, including its position as it is moved, to thereby coordinate insertion of a respective one of the gas nozzles into each package.

An apparatus for flushing a plurality of packages with gas, in accordance with the present invention, comprises a conveyor for linearly conveying a plurality of the packages in randomly spaced relationship to each other, and a linear servo motor positioned generally above the conveyor. A plurality of gas nozzle assemblies, each including a gas nozzle, are mounted on the linear servo motor for independent movement relative thereto.

The present apparatus includes sensors for sensing the position of each of the packages on the linear conveyor, so that as each package is conveyed to a position beneath the linear servo motor, and the position of the package is determined by the sensor. This permits operation of the linear servo motor so that a respective one of the nozzle assemblies is moved relative to the linear servo motor so that the gas nozzle of the nozzle assembly is inserted into the package. Gas is injected into the package from the gas nozzle to flush the interior with gas, while the package and the respective one of the nozzles are moved in concert with each other.

In one illustrated embodiment, each of the gas nozzles assemblies includes a pair of interconnected driven modules, so that relative movement of each pair of driven modules with respect to each other selectively adjusts the angle of the respective gas nozzle with respect to the linear servo motor. This promotes efficient and precise insertion of each gas nozzle into the contents of the respective package. In the alternative embodiment, each gas nozzle is mounted on a respective single one of the driven modules, with each nozzle operatively connected to a cam-actuated linkage. A cam track arrangement positioned adjacent to the linear servo motor acts on the linkage of each nozzle for pivoting the nozzle relative to its respective module as the module is moved on the linear servo motor, to thereby effect insertion of each nozzle into one of the packages being conveyed.

The apparatus preferably includes a vibratory drive for vibrating each of the packages as it is moved beneath the linear servo motor to facilitate insertion of each of the gas nozzles into contents of a respective one of the packages.

Features of the present method include:

(1) a method of reliably inserting an inflation tube into a randomly spaced, linear moving, open top bag, and traveling with bag for a period of time while inserting a fluid, and then closing the bag top to retain the fluid within the bag and retracting the tube (not necessarily in that order);

(2) detecting the leading edge of a randomly spaced bag, and controlling the position of the inflation tube to be able to be inserted into the bag;

(3) using a linear servo driven module controlled by a controller to position and transport the nozzle;

(4) using a second linear servo driven module controlled by a controller to alter the radial orientation of the nozzle for optimum insertion of the nozzle into the open mouth bag via a linkage connecting the nozzle and second linear servo driven module;

(5) providing a cam-track arrangement positioned adjacent to the linear servo motor, and providing each of the gas nozzles with a least one cam follower for operative engagement with the cam track arrangement for selectively adjusting the relative angle of each gas nozzle respect to the linear servo motor.

(6) using a multiple, linear servo driven modules controlled by a controller to move in independent and predetermined ways to insert respective inflation nozzles into a stream of randomly spaced linear moving open top bags etc.;

(7) using a multi-port rotary union to supply fluid to the respective nozzles and having the rotary union rotate such that the motion coordinated with the respective nozzle to prevent fluid supply hose entanglement;

(8) vibrating the product in the open mouth bag to fluidize the product within the bag thereby allowing the nozzle to be easily inserted into the contents of the bag without damaging the contents; and (9) inserting a fluid into a linear moving open mouth bag thereby displacing the pre-existing ambient fluid content of the bag with a new fluid.

While the present invention has been disclosed for purposes of flushing packages with gas, it will be recognized that a similar arrangement can be employed for insertion of articles or the like, such a coupons, tokens, or other items, into each package. Similarly, the present invention can be used to introduce other compounds or ingredients, such as flavoring, to be added to each package's contents. As such, the present invention contemplates the provision of a plurality of package processing members, shown as gas nozzles in the illustrated embodiments, which are independently moveable on a linear servo motor so that each processing member operatively engages a respective one of randomly-spaced packages, while each package and the respective one of the processing members are moved in concert with each other.

Other features and advantages will become readily apparent from the following detailed description, the accompanying drawings, and the appended claims.

DETAILED DESCRIPTION OF THE PREFERRED EMBODIMENT

Figure 1:
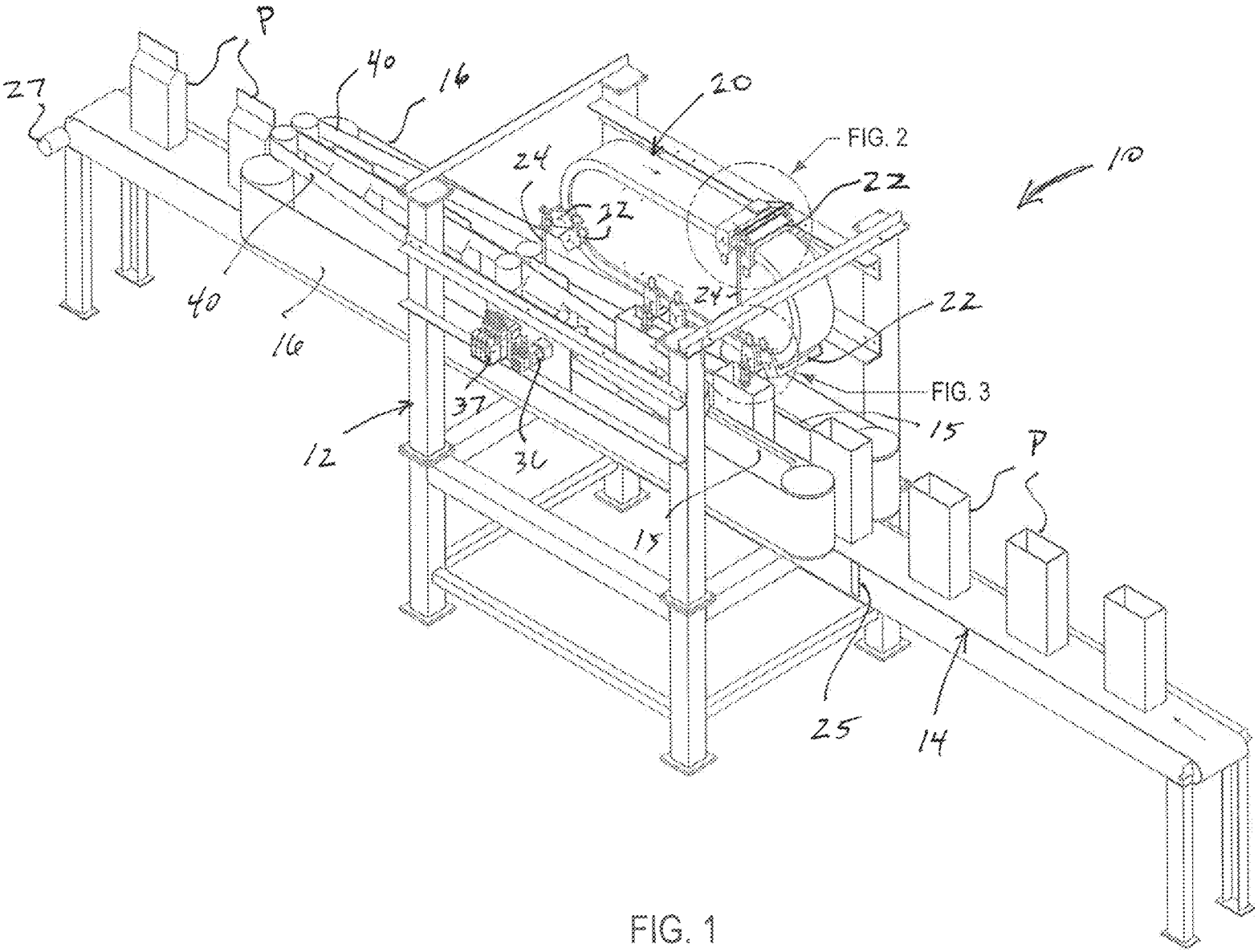
FIG. 1 is a diagrammatic view showing an apparatus for flushing packages with gas, embodying the principles of the present invention.

While the present invention is susceptible with the embodiment in various forms, they are shown in the drawings and will hereinafter be described a presently preferred embodiment, with the understanding that the present disclosure is to be considered as an exemplification of the invention, and is not intended to limit the invention to the specific embodiments illustrated.

The present invention is directed to an apparatus, and a method of operation, which is particularly suited for introducing a relatively inert gas, such as nitrogen, argon, carbon dioxide or the like, into a package, during packaging, in order to promote the freshness of the contents of the packages. By introducing the inert gas, or "flushing" the contents of each package, oxygen-containing air from each package can be displaced, thus promoting the freshness of the contents. The specific composition of the gas which is introduced, and the quantity introduced, can be selectively varied to control the oxygen content of each package, facilitating the usual storage and shipment of packages prior to retail sale.

In development of the present invention, certain performance criteria became evident in order to promote packaging efficiency and product quality. One problem to be addressed concerns the manner in which filled packages are typically presented for closing and sealing in a randomly spaced fashion, requiring coordination of a gas-flushing arrangement with the random package spacing. Additionally, the nature of the package contents, frequently granular in nature, presented issues, since insertion of a gas nozzle or the like into the granular product could be problematic, and even distribution of the flushing gas within the package needed to be ensured.

Notably, the present invention specifically addresses these issues, while promoting packaging efficiency. In particular, a linear servo motor, configured as a closed loop, includes individually programmable and positionable driven modules, which can be controlled in a manner to coordinate their movement with respective packages, even if randomly spaced. Additionally, inclusion of a vibratory drive in the region of gas-flushing desirably acts to "fluidize" the granular package contents, facilitating nozzle insertion, and promoting the desired distribution of the inert gas within the interior of the package.

As will be further described, one embodiment of the present invention is operated by having pairs of the driven modules of the linear servo motor act together for articulating a gas nozzle with respect to the servo motor. In an alternative embodiment, a cam arrangement is provided in operative association with the linear servo motor to effect the desired articulation of the gas nozzles, so that they are each inserted into a respective one of the packages being filled and sealed.

As will be appreciated, the present invention is particularly suited for effecting gas-flushing of packages attendant to filling. However, as will be recognized by those skilled in the art, the present apparatus, and method, can be practiced for some other type of package processing, such as for insertion of coupons, tokens, or other articles into each package, or for the introduction of other compounds or ingredients, such as flavoring, into each package. Thus, in the illustrated embodiments, the package processing members of the apparatus are shown in the form of gas-flushing nozzles which supply inert gas to respective ones of the packages being filled.

With reference now to FIGS. 1-4, a first embodiment of the present gas-flushing apparatus, designated 10, will be described. A frame 12 supports a product conveyor 14 upon which a plurality of packages P are linearly conveyed. As shown in FIG. 1, the packages P which are conveyed by conveyor 12 have been filled with product, with each package having an open mouth which will be sealed to complete packaging. The present invention functions by introduction of an inert gas through the open mouth of each package, with package sealing completed in conjunction with, or just subsequent to, gas-flushing.

Packages P are conveyed by linear conveyor 14 generally through frame 12, between a pair of spaced-apart, converging, package forming belts 16. Forming belts 16 act to shape and "square" each package to facilitate palletizing, and provide generally uniform filling of the package contents.

Notably, vibratory drives 15 are provided in operative association with linear conveyor 14, generally behind forming belts 16, and beneath conveyor 14 (not shown) to vibrate and "fluidize" the granular contents of each package P. This facilitates insertion of a gas nozzle into each package, as will be described, and promotes uniform distribution of the inert flushing gas within each package.

Insertion of a gas-flushing nozzle into each package is effected by the provision of linear servo motor 20 mounted on frame 12 generally above linear conveyor 14. Linear servo motor 20, provided in the form of a closed loop positioned above the linear conveyor 14, includes a plurality of individually programmable and positionable driven modules 22. Driven modules 22 can be advanced around the closed loop of the linear servo motor 20 in order to permit insertion and withdrawal of a gas-flushing nozzle into each package P, while permitting the gas-flushing nozzle to be moved in concert a respective one of the packages P as inert gas is introduced into the package.

The inert gas to be introduced into each package P is inserted into the packages by the provision of a plurality of gas-flushing nozzles 24 which are mounted on the driven modules 22 for insertion into each package, and for movement together with the package as it is conveyed on linear conveyor 14. Each gas flushing nozzle 24 is each mounted on a respective one of driven modules 22, preferably for pivotal movement with respect to the driven module. By providing articulated, pivotal movement of each gas nozzle 24 with respect to the driven module 22 of the linear conveyor 20, each nozzle can be positioned for insertion into a respective one of the packages P as the package is passed generally beneath the linear servo motor 20.

Figure 2:
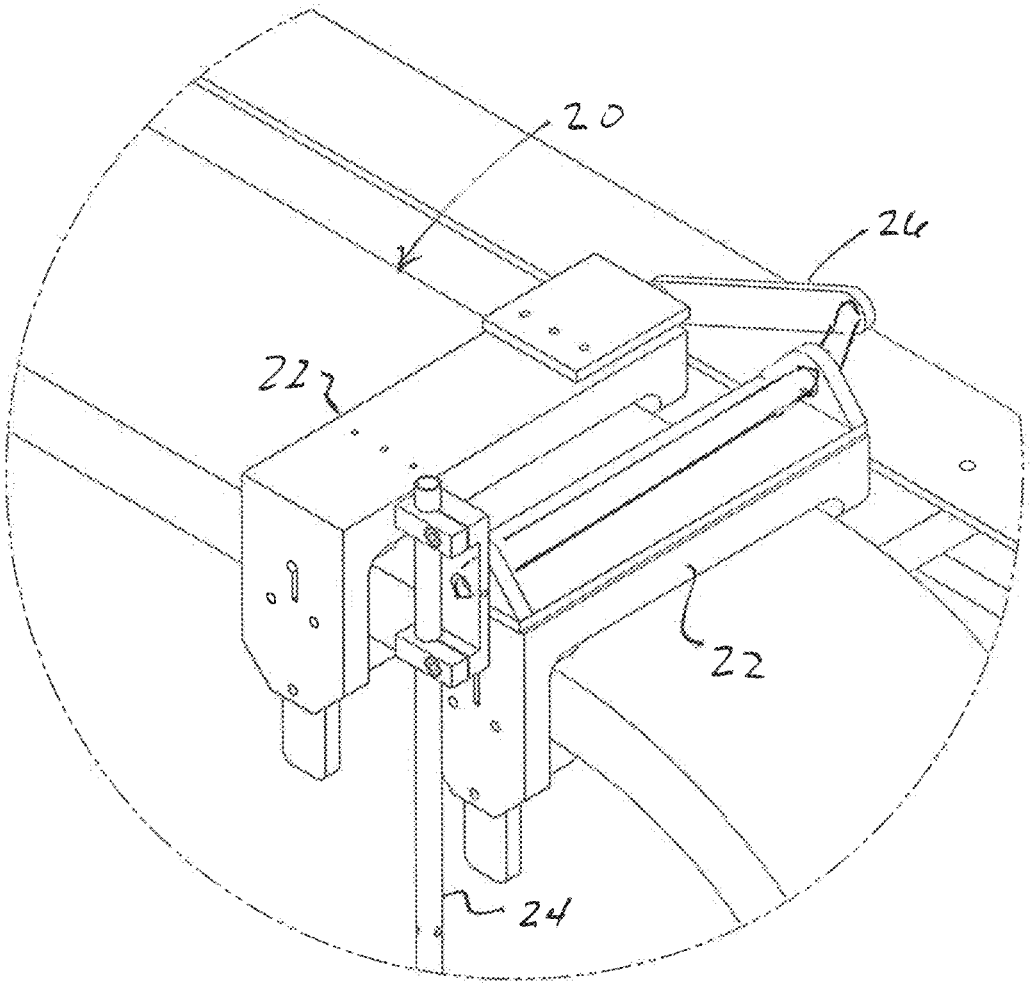
FIG. 2, is a detailed, diagrammatic view taken where indicated in FIG. 1.

In this embodiment, each gas nozzle 24 is articulated by way of a linkage 26 operatively connected to an adjacent one of the drive modules 20. As best shown in FIG. 2, this arrangement functions such that changing the relative spacing between the driven modules 22 acts through linkage 26 to selectively vary the angle and articulate the gas nozzle 24. The pair of adjacent driven modules 22 and the associated gas nozzle 24 thus function together as a gas nozzle assembly which can be selectively positioned on the linear servo motor 20. As noted, the vibratory drive of the apparatus desirably acts to "fluidize" the granular contents of each package, thereby facilitating the insertion of each gas nozzle 24 into a respective one of the packages.

Figure 3:
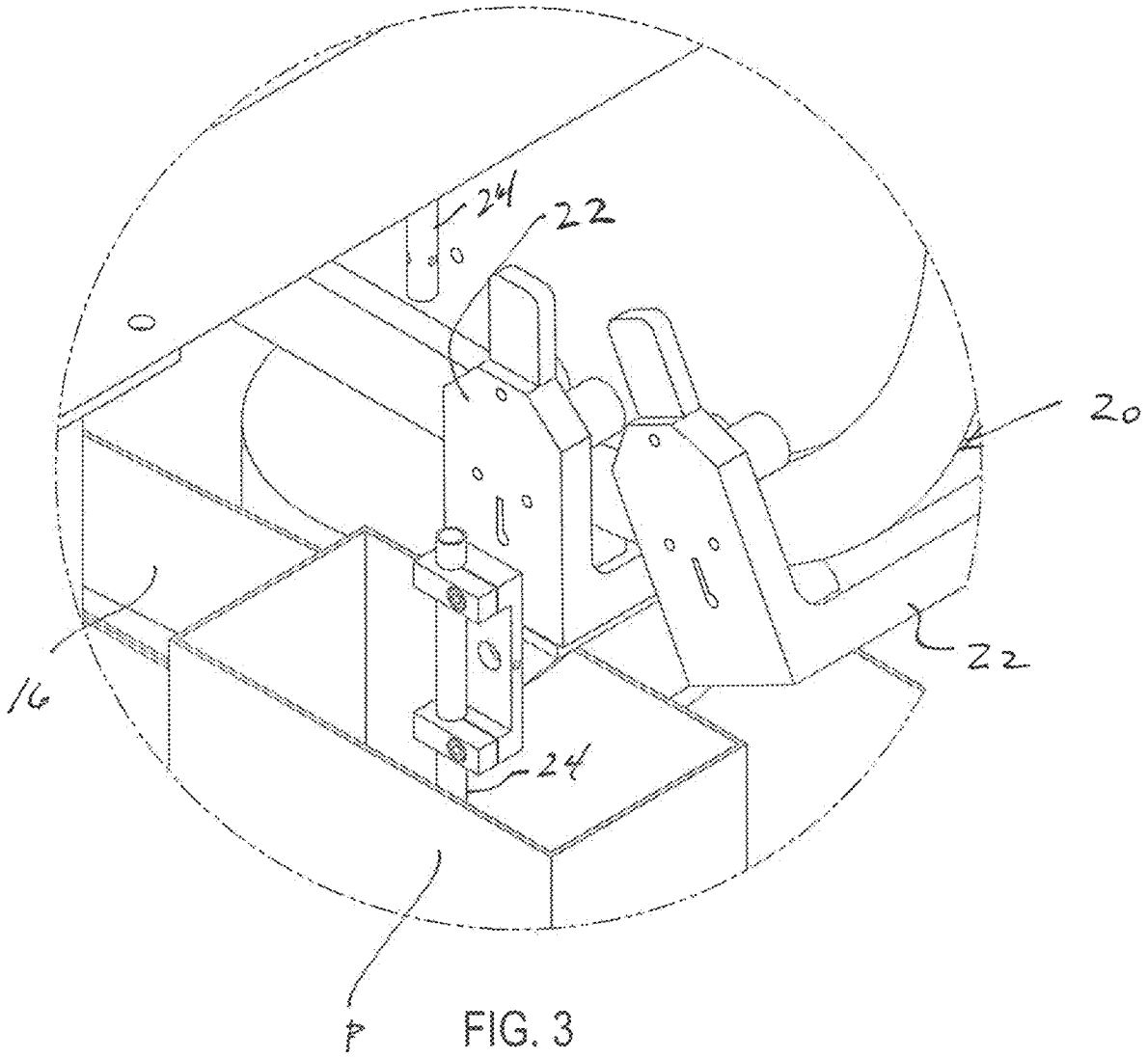
FIG. 3 is a detailed, diagrammatic view taken where indicated in FIG. 1.

FIG. 3 illustrates the insertion of one of the gas nozzles 24 into a respective one of the packages P as the driven modules 22 and the gas nozzle 24 are moved in concert with the package P as it is conveyed on a linear conveyor 14.

Figure 4:
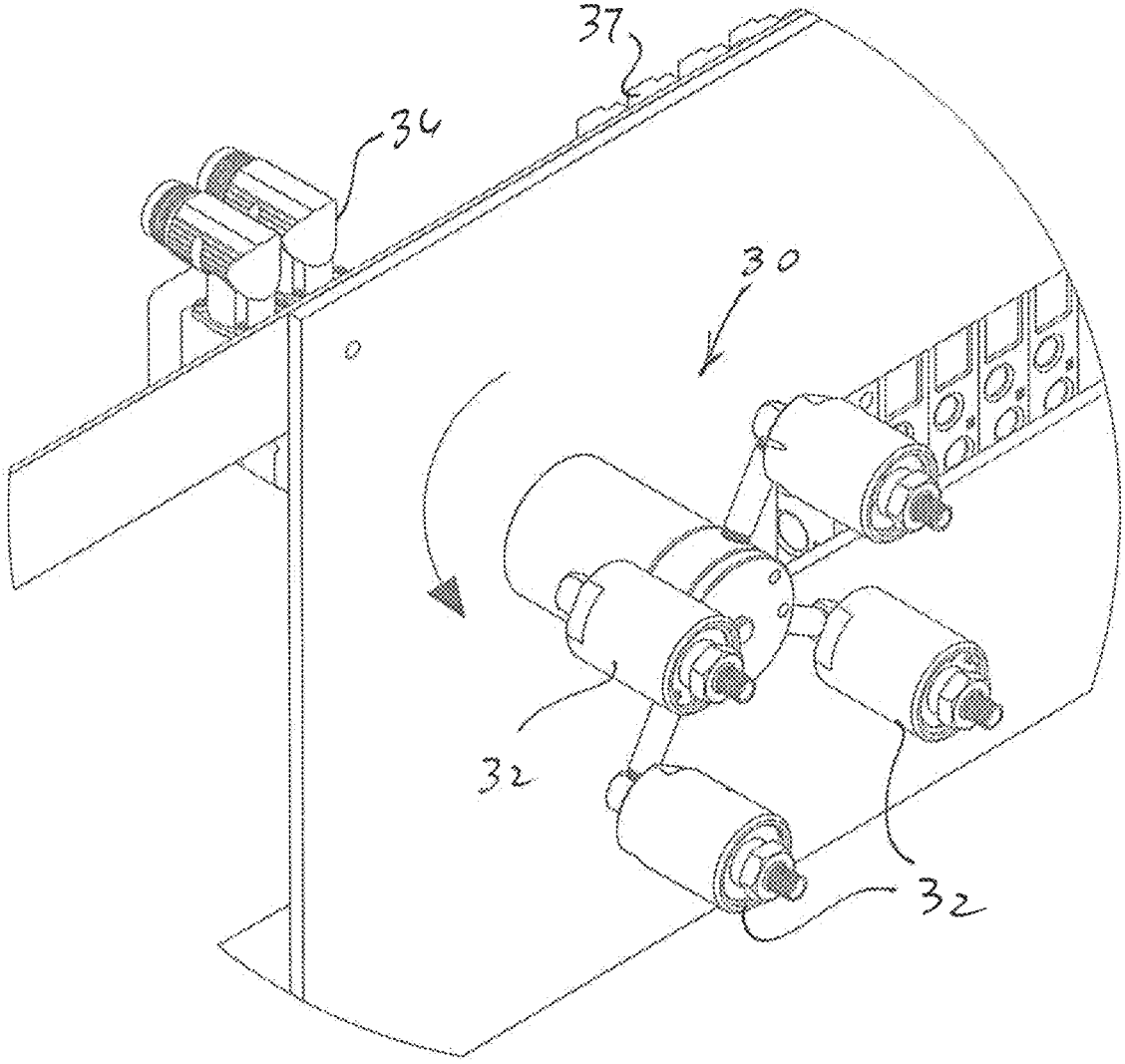
FIG. 4 is a diagrammatic view illustrating a gas rotary union of the present apparatus.

The flow of insert gas to each of the gas-flushing nozzles 24 is effected by the provision of a multiple-passage rotary union 30, as shown in FIG. 4. The rotary union 30, shown diagrammatically in FIG. 4, directs gas to a plurality of single passage rotary unions 32, each connected by a suitable flexible conduit (shown at 33 in diagrammatic FIG. 5) to a respective one of the gas nozzles 24. A servo motor 36 operates rotary union 30 in conjunction with operation of driven modules 22 on linear servo motor 20, so that flow of inert gas to the nozzles 24 is coordinated with the movement of driven modules 22 and packages P as they are conveyed on conveyor 14.

In the illustrated embodiment, a pair of bag closing belts 40 are provided generally above package forming belts 16. As will be observed, closing belts 40 converge generally toward each other from the area in which gas flushing is effected, to a region downstream thereof, at which point gas flushing is complete. Each nozzle 24 is removed from a respective one of the packages P generally upstream of the convergence of the closing belts 40, with each package P having a generally upright configuration, with the open mouth of each package closed for subsequent sealing. Sealing is preferably effected immediately downstream of the gas-flushing apparatus in order to minimize leakage of the flushing gas from within each package.

An important aspect of the present invention is the provision of sensors for detecting and monitoring the position of each package P, and thereby coordinating movement of driven modules 22 with the packages to effect the desired insertion, and removal, of nozzles 24 into and out of each package P. A bag position sensor 25, and a conveyor encoder 27, operate in conjunction with the linear servo motor drive 20, and in coordination with a valve bank 37 which is operated to selectively supply inert gas to the rotary union 30. An important aspect of the present invention is detecting the leading edge of each package, which may be randomly spaced, and controlling the position of the gas-flushing nozzle to facilitate insertion into a respective one of the packages. The linear servo motor 20 is then operated so that the nozzle is moved in concert with the package to effect gas flushing.

As noted, in this embodiment, a second driven module 22 of the linear servo motor 20 is controlled to articulate and alter the radial orientation of the nozzle, to thereby facilitate optimum insertion of the nozzle into the open mouth of each package. Linkage 26 connecting the nozzle 24 with the second driven module 22 thus functions to articulate the nozzle 24 with respect to the driven module 22 on which the nozzle is pivotally mounted.

Further features of the present method include the use of multiple, linear servo driven modules, controlled by a controller, to move in independent and predetermined ways to insert respective inflation nozzles into a stream of randomly spaced, linear moving open top bags. The use of a multi-port rotary union to supply fluid to the respective nozzles, with rotation of the union, desirably acts to coordinate the motion of each nozzle with respect to each package, while preventing entanglement of the fluid supply hoses. As noted, a vibratory drive desirably acts to fluidize the contents of each package, thereby facilitating insertion of the nozzle into the contents without damaging the contents.

Figure 5:
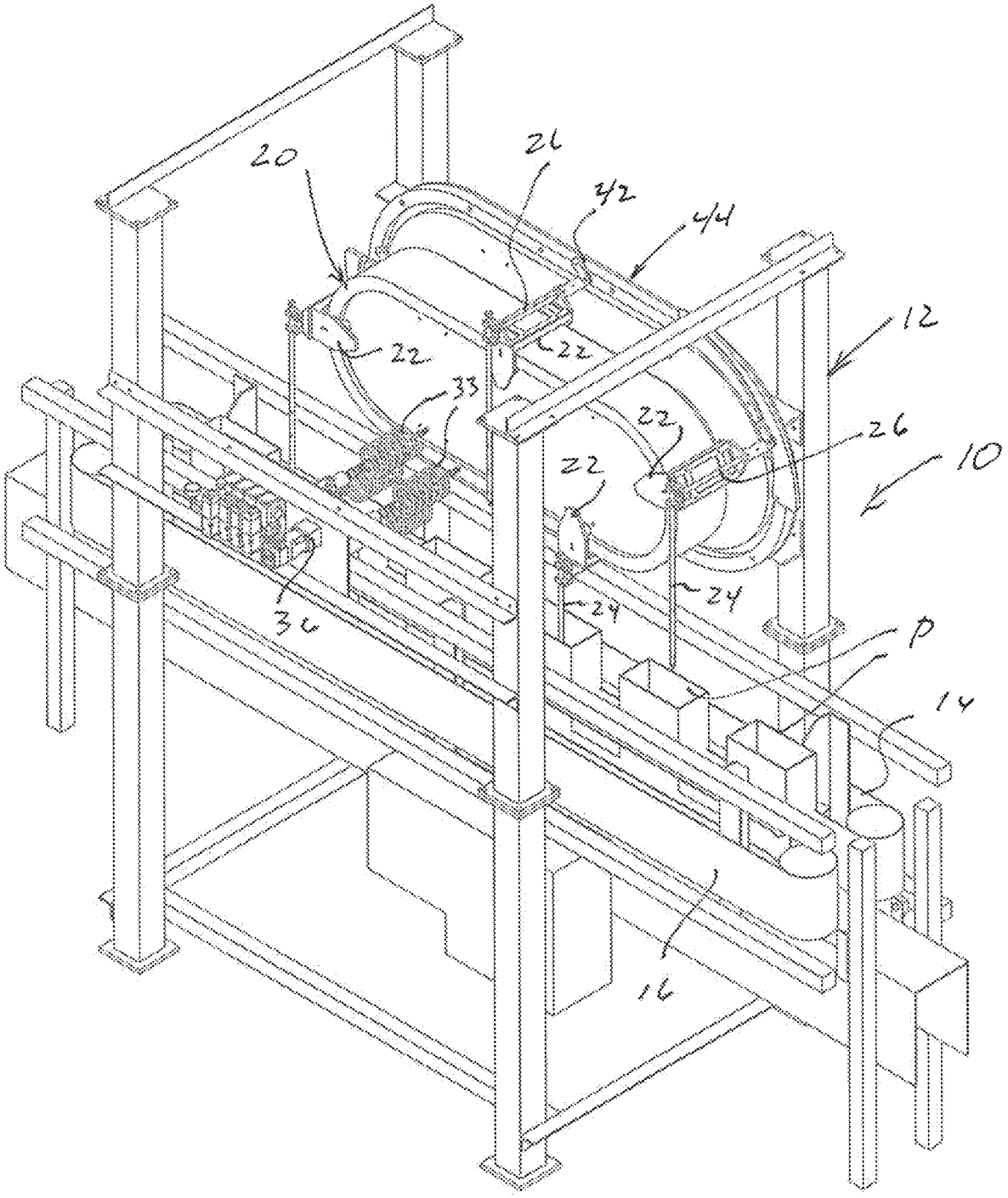
FIG. 5 is a diagrammatic view showing an alternative embodiment of the present apparatus.
Figure 6:
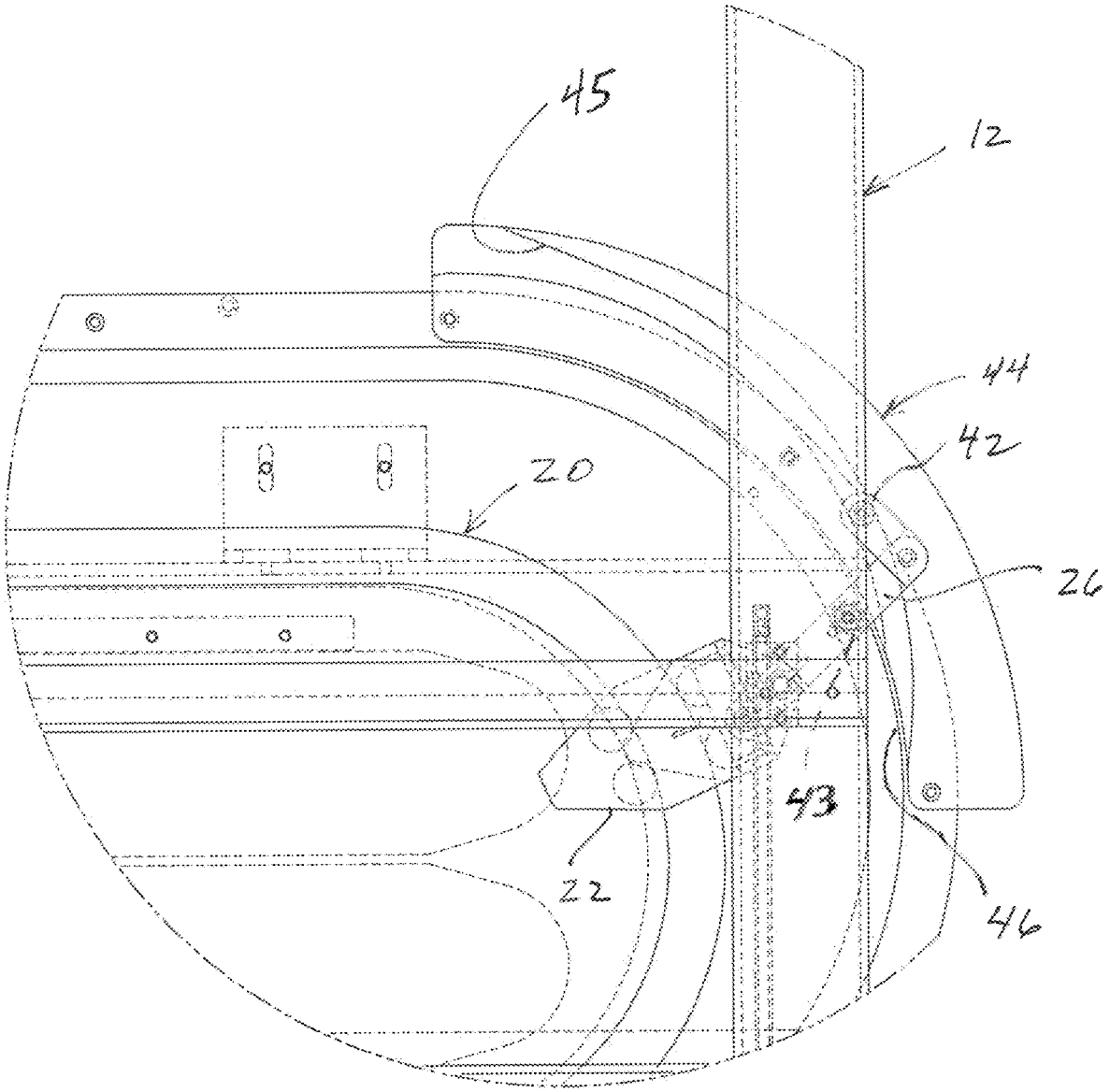
FIG. 6 is a diagrammatic view illustrating features of the alternative embodiment of the present invention.

With reference now to FIGS. 5 and 6, therein is illustrated an alternative embodiment of the present invention. In this embodiment, each gas flushing nozzle 24 is mounted on a respective driven module 22, wherein the driven modules are positioned singularly (rather than in pairs, as in the previous embodiment). In this embodiment, the linkage 26 for articulating and altering the relative angle of each nozzle 24 with respect to the linear servo motor is effected by the provision of cam followers 42,43 on each linkage 26, and a cam track arrangement 44 positioned in operative association with the linear servo motor 20, including cam tracks 45,46.

By this arrangement, as each driven module 22 is moved along the closed loop of linear servo motor 20, cam follower 42 engages the cam arrangement 44 to alter the relative angular position of each nozzle 24 with respect to the driven module 22.

From the foregoing, it will be observed that numerous modifications and variations can be effected without departing from the true spirit and scope of the novel concept of the present invention.

The invention claimed is:

1. A method of flushing packages with gas, comprising the steps of:

linearly conveying a plurality of packages each having an open mouth, including randomly spacing said packages from each other;

providing a linear servo motor, having a plurality of independently positionable driven modules, positioned generally above said packages;

providing a plurality of gas nozzles each mounted on a respective one of said driven modules, and independently moving said gas nozzles on said linear servo motor;

inserting each of said gas nozzles into a respective one of said packages through the open mouth thereof while the gas nozzle is moved on said linear servo motor by the respective one of said driven modules in concert with the respective package; and flushing the respective package with gas, and thereafter removing each said nozzle from the respective package.

2. A method of flushing packages with gas in accordance with claim 1, including:

selectively adjusting the relative angle of each said gas nozzle with respect to said linear servo motor.

3. A method of flushing packages with gas in accordance with claim 2, including:

providing a pair of driven modules on said linear servo motor for each of said gas nozzles, and adjusting the relative spacing between said pair of driven modules for adjusting the relative angle of each gas nozzle with respect to said linear servo motor.

4. A method of flushing packages with gas in accordance with claim 2, including providing a cam-track arrangement positioned adjacent to said linear servo motor, and providing each of said gas nozzles with a least one cam follower for operative engagement with said cam track arrangement for selectively adjusting the relative angle of each said gas nozzle respect to the linear servo motor.

5. A method of flushing packages with gas in accordance with claim 1, including:

vibrating each of said packages during insertion of each said gas nozzle to facilitate insertion of each gas nozzle into contents of each said package.

6. A method of flushing packages with gas in accordance with claim 1, including:

detecting the position of each of said packages to coordinate insertion of a respective one of said gas nozzles into each said package.

7. A method of flushing packages with gas in accordance with claim 1, wherein said linear servo motor comprises a closed loop positioned generally above said linearly conveyed packages, each of said gas nozzles being independently movable about said closed loop.

8. An apparatus for flushing a plurality of packages with gas, comprising:

a linear conveyor for linearly conveying a plurality of said packages in randomly spaced relationship to each other;

a linear servo motor positioned generally above said conveyor;

a plurality of gas nozzle assemblies, each including a gas nozzle, mounted on said linear servo drive for independent movement relative thereto; and sensors for sensing the position of each said package on said linear conveyor, so that as each said package is conveyed beneath said linear servo motor, and the position of the package is determined by said sensors, so that a respective one of said nozzle assemblies is moved relative to said linear servo motor so that the gas nozzle of the nozzle assembly is inserted into the package to flush the interior with gas while each said package and the respective one of said nozzles are moved in concert with each other.

9. An apparatus for flushing a plurality of packages with gas in accordance with claim 8, wherein said linear servo motor comprises a plurality of independently positionable driven modules, each of said gas nozzles assemblies including a pair of interconnected ones of said driven modules, so that movement of each said pair of driven modules with respect to each other selectively adjusts the angle of the respective gas nozzle with respect to the linear servo motor.

10. An apparatus for flushing a plurality of packages with gas in accordance with claim 8, wherein said linear servo motor comprises a plurality of independently positionable driven modules, each of said gas nozzles being mounted on a respective one of said driven modules, said apparatus including a cam arrangement positioned in operative association with said linear servo motor, each of said gas nozzles being moved relative to the respective one of said driven modules by movement relative to said cam arrangement.

11. An apparatus for processing a plurality of packages, comprising:

a linear conveyor for linearly conveying a plurality of said packages in randomly spaced relationship to each other;

a linear servo motor positioned generally above said conveyor;

a plurality of processing members mounted on said linear servo motor for independent movement relative thereto; and sensors for sensing the position of each said package on said linear conveyor, so that as each said package is conveyed beneath said linear servo motor the position of the package is determined by said sensors, so that a respective one of said processing members is moved relative to said linear servo motor, so that the processing member operatively engages a respective one of said packages while each said package and the respective one of said processing members are moved in concert with each other.

12. An apparatus for processing a plurality of packages in accordance with claim 11, wherein said linear servo motor comprises a plurality of independently position driven modules, each of said gas nozzles assemblies including a pair of interconnected ones of said driven modules, so that movement of each said pair of driven modules with respect to each other selectively adjusts the angle of the respective gas nozzle with respect to the linear servo motor.

13. An apparatus for processing a plurality of packages in accordance with claim 11, wherein said linear servo motor comprises a plurality of independently positionable driven modules, each of said processing members being mounted on a respective one of said driven modules, said apparatus including a cam arrangement positioned in operative association with said linear servo motor, each of said gas nozzles being moved relative to the respective one of said driven modules by movement relative to said cam arrangement.

14. An apparatus for processing a plurality of packages in accordance with claim 11, wherein each of said processing members comprises a gas flushing nozzle for insertion into a respective on of said packages.

* * * * *